US007616163B2

(12) United States Patent
Montgomery et al.

(10) Patent No.: US 7,616,163 B2
(45) Date of Patent: Nov. 10, 2009

(54) MULTIBAND TUNABLE ANTENNA

(75) Inventors: Mark T. Montgomery, Melbourne Beach, FL (US); Frank M. Caimi, Vero Beach, FL (US); Paul Tornatta, Melbourne, FL (US)

(73) Assignee: Sky Cross, Inc., Melbourne, FL (US)

( * ) Notice: Subject to any disclaimer, the term of this patent is extended or adjusted under 35 U.S.C. 154(b) by 219 days.

(21) Appl. No.: 11/627,357

(22) Filed: Jan. 25, 2007

(65) Prior Publication Data

US 2007/0216590 A1 Sep. 20, 2007

Related U.S. Application Data

(60) Provisional application No. 60/762,196, filed on Jan. 25, 2006.

(51) Int. Cl.
*H01Q 9/00* (2006.01)

(52) U.S. Cl. ..... 343/745; 343/722; 343/749

(58) Field of Classification Search ..... 343/722, 343/745, 749, 752, 702
See application file for complete search history.

(56) References Cited

U.S. PATENT DOCUMENTS 3,909,830 A * 9/1975 Campbell ..... 343/703
4,222,053 A * 9/1980 Newcomb ..... 343/722
4,268,834 A * 5/1981 Henry ..... 343/858
4,893,131 A * 1/1990 Smith et al. ..... 343/713
5,754,143 A 5/1998 Warnagiris et al.
6,140,966 A 10/2000 Pankinaho
6,300,913 B1 10/2001 Davidson
6,624,786 B2 9/2003 Boyle
6,697,030 B2 * 2/2004 Gleener ..... 343/860
6,836,252 B2 12/2004 Tai et al.

* cited by examiner

*Primary Examiner*—Tho G Phan
(74) *Attorney, Agent, or Firm*—Beusse Wolter Sanks Mora & Maire, P.A.; John L. DeAngelis

(57) ABSTRACT

One embodiment of the invention relates to an antenna providing a tunable resonant frequency within a low frequency band and further providing a high resonant frequency, the antenna comprises a first radiating structure of a first effective electrical length, a second radiating structure of a second effective electrical length having a fractional integer relationship to a wavelength related to the high resonant frequency and a variable reactance element connecting the first and the second radiating structures, wherein varying a reactance of the variable reactance element tunes the antenna within the low frequency band.

34 Claims, 7 Drawing Sheets

MULTIBAND TUNABLE ANTENNA

The present application claims the benefit of under Section 119(e) of the provisional patent application field on Jan. 25, 2006 assigned application No. 60/762,196.

FIELD OF THE INVENTION

The present invention relates generally to antennas and antenna systems and more specifically to embedded antennas and antenna systems operative at certain frequencies, including digital video broadcast frequencies.

BACKGROUND OF THE INVENTION

It is known that antenna performance is dependent on the size, shape, and material composition of the antenna elements, the interaction between elements and the relationship between certain antenna physical parameters (e.g., length for a linear antenna and diameter for a loop antenna) and the wavelength of the signal received or transmitted by the antenna. These physical and electrical characteristics determine several antenna operational parameters, including input impedance, gain, directivity, signal polarization, resonant frequency, bandwidth and radiation pattern. Since the antenna is an integral element of a signal receive and transmit path of a communication device, antenna performance directly affects device performance.

Generally, an operable antenna should have a minimum physical antenna dimension on the order of a half wavelength (or a multiple thereof) of the operating frequency to limit energy dissipated in resistive losses and maximize transmitted or received energy. Due to the effect of a ground plane image, a quarter wavelength antenna (or odd integer multiples thereof) operative above a ground plane exhibits properties similar to a half wavelength antenna. Communications device product designers prefer an efficient antenna that is capable of wide bandwidth and/or multiple frequency band operation, electrically matched (e.g., impedance matching) to the transmitting and receiving components of the communications system, and operable in multiple modes (e.g., selectable signal polarizations and selectable radiation patterns).

Given the advantageous performance of quarter and half wavelength antennas, conventional antennas are typically constructed so that the antenna length is on the order of a quarter wavelength of the radiating frequency and the antenna is operated over a ground plane, or the antenna length is a half wavelength without employing a ground plane. These dimensions allow the antenna to be easily excited and operated at or near a resonant frequency (where the resonant frequency (f) is determined according to the equation $c=\lambda f$, where c is the speed of light and $\lambda$ is the wavelength of the electromagnetic radiation).

Half and quarter wavelength antennas limit energy dissipated in resistive losses, and maximize the transmitted energy. But as the operational frequency increases/decreases, the operational wavelength decreases/increases and the antenna element dimensions proportionally decrease/increase. In particular, as the frequency of the received or transmitted signal decreases, the dimensions of the quarter wavelength and half wavelength antenna proportionally increase to maintain a resonant condition. The resulting larger antenna, even at a quarter wavelength, may not be suitable for use with certain communications devices, especially portable and personal communications devices intended to be carried by a user. Since these antennas tend to be larger than the communications device with which they operate, the antenna is typically mounted with a portion of the antenna protruding from the communications device. Such mounting schemes subject the antenna to possible damage.

The burgeoning growth of wireless communications devices and systems has created a substantial need for physically smaller, less, obtrusive, and more efficient antennas that are capable of wide bandwidth or multiple frequency-bank operation, and/or operation in multiple modes (i.e., selectable radiation patterns or selectable signal polarizations). For example, operation in multiple frequency bands may be required for operation of the communications device with multiple communications systems or signal protocols within different frequency bands. For example, a cellular telephone system transmitter/receiver and a global positioning system receiver operate in different frequency bands using different signal protocols. Operation of the device in multiple countries also requires multiple frequency band operation since communication frequencies are not commonly assigned in different countries.

Smaller packaging of state-of-the-art communications devices, such as personal communications handsets and laptop computers, does not provide sufficient space for the conventional quarter and half wavelength antenna elements. Physically smaller antennas operable in the frequency bands of interest (i.e., exhibiting multiple resonant frequencies and/or wide bandwidth to cover all operating frequencies of communications device) and providing the other desired antenna-operating properties (input impedance, radiation pattern, signal polarizations, etc.) are especially sought after.

To overcome the antenna size limitations imposed by handset and personal communications devices, antenna designers have turned to the use of slow wave or meanderline structures where the structure's physical dimensions are not equal to the effective electrical dimensions. Recall that the effective antenna dimensions should be on the order of a half wavelength (or a quarter wavelength above a ground plane) to achieve the beneficial radiating and low loss properties discussed above. Generally, a slow-wave structure is defined as one in which the phase velocity of the traveling wave is less than the free space velocity of light. The wave velocity (c) is the product of the wavelength and the frequency and takes into account the material permittivity and permeability, i.e., $c/((\mathrm{sqrt}(\epsilon_r)\mathrm{sqrt}(\mu_r))=\lambda f$. Since the frequency does not change during propagation through a slow wave structure, if the wave travels slower (i.e., the phase velocity is lower) than the speed of light, the wavelength within the structure is lower than the free space wavelength. The slow-wave structure de-couples the conventional relationship between physical length, resonant frequency and wavelength.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased. Thus if two structures are to operate at the same resonant frequency, as a half-wave dipole, for instance, then the structure propagating a slow wave will be physically smaller than the structure propagating a wave at the speed of light. Such slow wave structures can be used as antenna elements or as antenna radiating structures.

Current antenna solutions for digital video broadcast (DVB) or digital television broadcast utilize external dongle antenna assemblies that are unwieldy, connected by wire to the television receiver and in most embodiments offer poor performance over a broad bandwidth. DVB systems may operate at the traditional television broadcast carrier frequencies, as well as cellular, PCS, DCS, and UMTS carrier frequencies. Efficient antenna operation is desired over all operative frequency bans to permit a portable or mobile receiving device to receive multiple DB signals. The use of multiple antennas within the receiving device is generally discouraged due to the space requirements for multiple antennas.

Reception of video signals by mobile or portable receivers is further complicated by signal fading and multi-path interferences. The problem of acceptable performance is exacerbated by the use of relatively simple receivers operating with a low gain antenna to receive the video signal.

Prior art television and video antennas include passive and active devices. Passive antennas may comprise a whip antenna or a loaded whip antenna having a length substantially less than ¼ wavelength at the operating frequency. Generally the whip (monopole) may exhibit fundamental resonance at one frequency somewhere in the desired spectral range covered by the receiver, with a maximum bandwidth limit governed by the well known Chu-Harrington relation. The Chu-Harrington Limit establishes the minimum volumetric antenna size for a given bandwidth and radiometric efficiency; or conversely the maximum bandwidth the antenna will present for a given volumetric size and efficiency/ At frequencies outside this bandwidth, the antenna becomes less efficient at converting received wave energy into a usable electrical signal. Nevertheless, whip antennas have been used for many years for portable television signal reception, albeit with non-optimal results.

An active solution for improving the bandwidth limitations of receive-only antennas is to incorporate an amplifier at the antenna terminals. The amplifier can be designed to match the impedance of the antenna over a broad frequency range, as is known. This approach has several drawbacks: 1) the amplifier mush have a broad bandwidth and low noise contribution over the entire received signal frequency range, and 2) the amplifier must exhibit high linearity and low distortion even at high signal levels to prevent mixing of signals appearing in our out of band. With respect to item 1), the noise performance of the antenna amplifier combination is seldom as good as that achievable over a narrower bandwidth. Regarding item 2), proximity to high power transmitter widespread in urban environments can cause interference in even the best receiver designs. Also, signal mixing can produce spurious signals in the desired passband.

Very small antennas, as required in video-receiving laptop computers and handheld or portable video receivers, are particularly sensitive to noise interference from on-board digital circuits. This noise may be broadband or within the passband of the receiver's "front end" amplifier.

BRIEF DESCRIPTION OF THE INVENTION

One embodiment of the invention comprises an antenna providing a tunable resonant frequency within a low frequency band and further providing a high resonant frequency. The antenna comprising a first radiating structure of a first effective electrical length, a second radiating structure of a second effective electrical length having a fractional integer relationship to a wavelength related to the high resonant frequency and a variable reactance element connecting the first and the second radiating structures, wherein varying a reactance of the variable reactance element tunes the antenna within the low frequency band.

BRIEF DESCRIPTION OF THE DRAWINGS

The present invention can be more easily understood and the advantages and uses thereof more readily apparent when the following detailed description of the present invention is read in conjunction with the figures briefly described below. In accordance with common practice, the various described features are not drawn to scale, but are drawn to emphasize specific features relevant to the invention. Like reference characters denote like elements throughout the figures and text.

DESCRIPTION OF THE INVENTION

Figure 1:
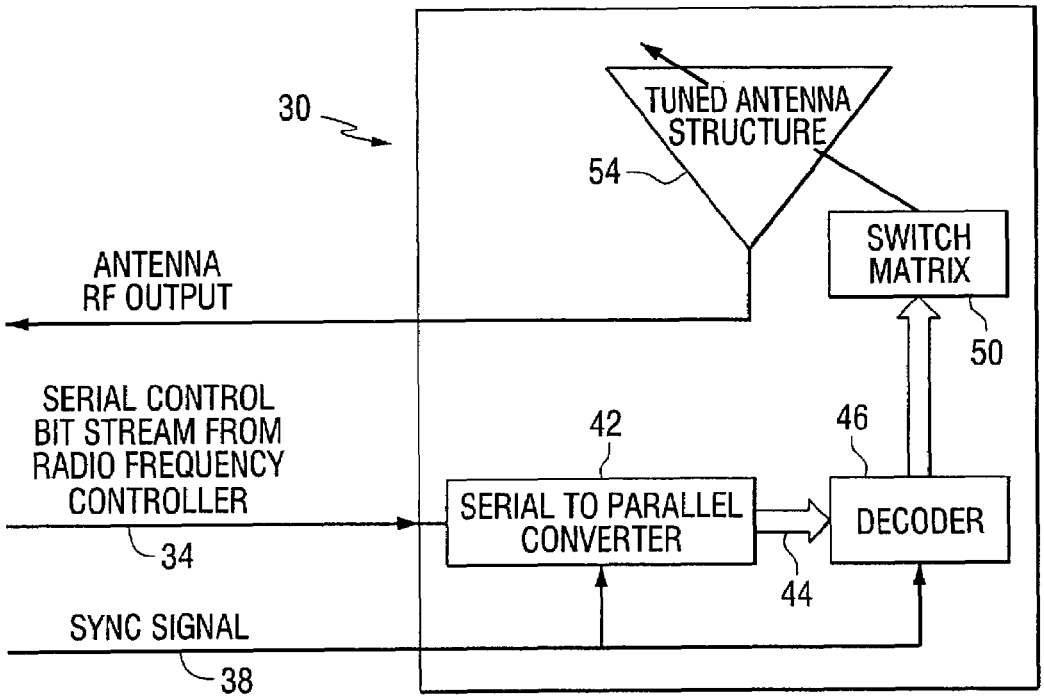
FIGS. 1-4 illustrate embodiments of an antenna system constructed according to the teachings of the present invention.

Before describing in detail the particular method and apparatus related to antennas and antenna systems of the present invention, it should be observed that the present invention resides primarily in a novel and non-obvious combination of elements and process steps. So as not to obscure the disclosure with details that will be readily apparent to those skilled in the art, certain conventional elements and steps have been presented with lesser detail, while the drawings and the specification described in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

The antennas and antenna systems of the present inventions advantageously presents a narrower bandwidth than prior art antennas and antenna systems and can therefore improve the signal-to-noise ratio of the received signal. Prior art antenna system do not optimize antenna performance by tuning the antenna resonance to specific frequencies or frequency bands according to tuning of the receiver, resulting in suboptimal antenna performance (efficiency). The present invention teaches antenna systems having tuning capabilities to improve signal reception, and tunable multiband antenna structures to alleviate certain propagation challenges encountered with typical video receivers.

The present invention provide efficient antenna system and antenna operation on one (or several) channels (i.e., where a channel comprises a carrier frequency and a frequency band above and below the carrier bandwidth) to which the receiver is tuned. The invention therefore provides a smaller antenna than prior art antennas with similar functionality, since in one embodiment the receiver actively and automatically commands the antenna to operate over a prescribed frequency region or at a prescribed resonant frequency. Tuning the antenna systems and/or the antennas according to the present invention may also reduce interference problems experienced in multiple signal urban environments.

The teachings of the present inventions provide improved reception of DVB (or any other received signals) where the transmitted signal bandwidth is within the passband of the antenna and where the receiver must tune over a larger bandwidth than is efficiently achievable from a single fix-tuned antenna. Advantageously, the present invention reduce interference from proximate strong radiators or on-board noise sources and improve received signal strength. These beneficial features result from the inherent selectivity provided by the antenna's relatively smaller bandwidth compared to the prior art antennas and from the improved radiation efficiency of the antenna resulting from active control of the resonant frequency to match the desired received signal at its nominal band center.

The selectivity offered by the present antenna systems and antennas when operating in the receiving mode also allows interoperability with communications devices that include a transmitter, such as a cellular telephone.

In one embodiment, the antenna systems of the present inventions are self-contained (for example, an antenna module comprising the radiating structures and operative electronics elements) and internal to the wireless device, thereby improving the durability of the wireless device with respect to prior art devices that incorporate clumsy whip antennas.

One embodiment of an antenna system 30 constructed according to the teachings of the present inventions is depicted in a block diagram of FIG. 1.

The antenna system 30 is characterized by two inputs (control signals supplied by the DVB (for example receiving system (not shown) and one output. A first input signal (provided on an input line 34) comprises a serial data stream from a microprocessor or other digital device (e.g., a radio frequency controller) that contains information as to the channel or frequency to which the DVB receiving system is tuned. The information in digital from may be contained in one or more data bytes. A clock pulse or other synchronizing signal (provided on an input line 38) commands a serial to parallel converter 42 to sample the serial bit stream at the appropriate time to capture the serial data indicating the frequency or channel of the receiving system.

The data is latched and parallel data (shown schematically as a double-line arrowhead 44 in FIG. 1) is supplied to a decoder 46 that interprets the data as required to derive digital signals for controlling RF (radio frequency) switches in a switch matrix 50 that "switch in" or "switch out" (configure) various conductive elements of an antenna structure 54, i.e., changing the electrical length of the structure and hence its resonant frequency. Alternatively, the switches may switch-in or switch-out capacitors (or inductors) within the antenna structure 54 to affect a reactive parameter and thereby control the resonant frequency. The switches remain latched in the decoded state until a new serial bit stream, indicating that the DVB receiving system has been tuned to a different frequency, is provided.

Figure 2:
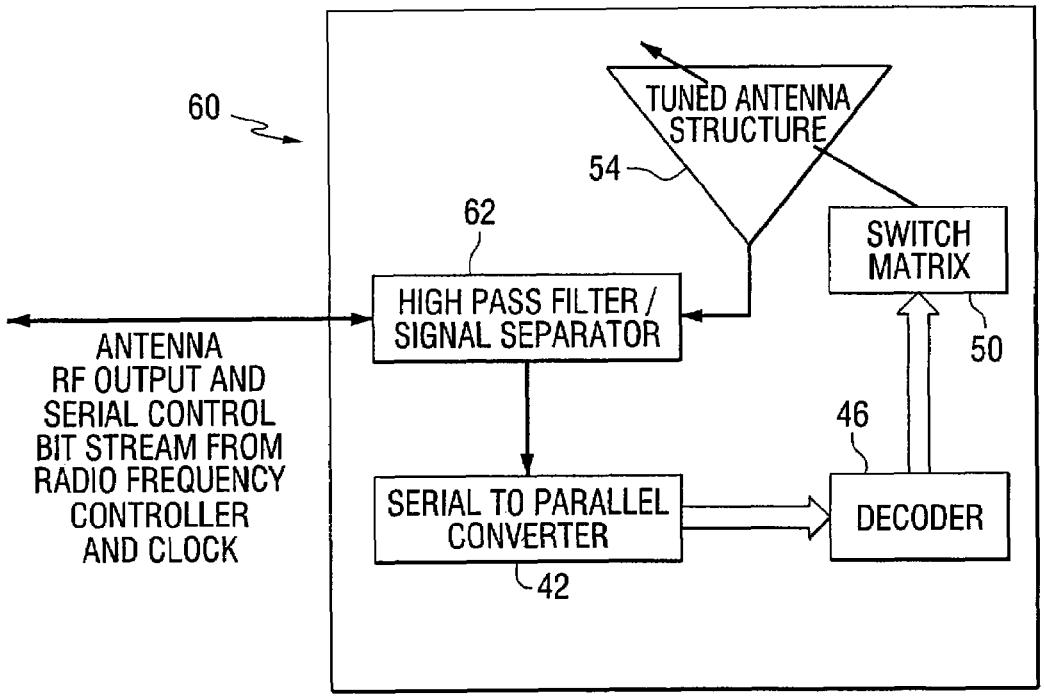

In another embodiment, an antenna system 60 of FIG. 2 incorporates a multiplexing scheme where a serial data stream representing the receiving frequency and an RF output are combined in a two wire conductor (coaxial cable, stripline, microstrip, etc.). The signals are separated by a high pass filter/signal separator 62.

Figure 3:
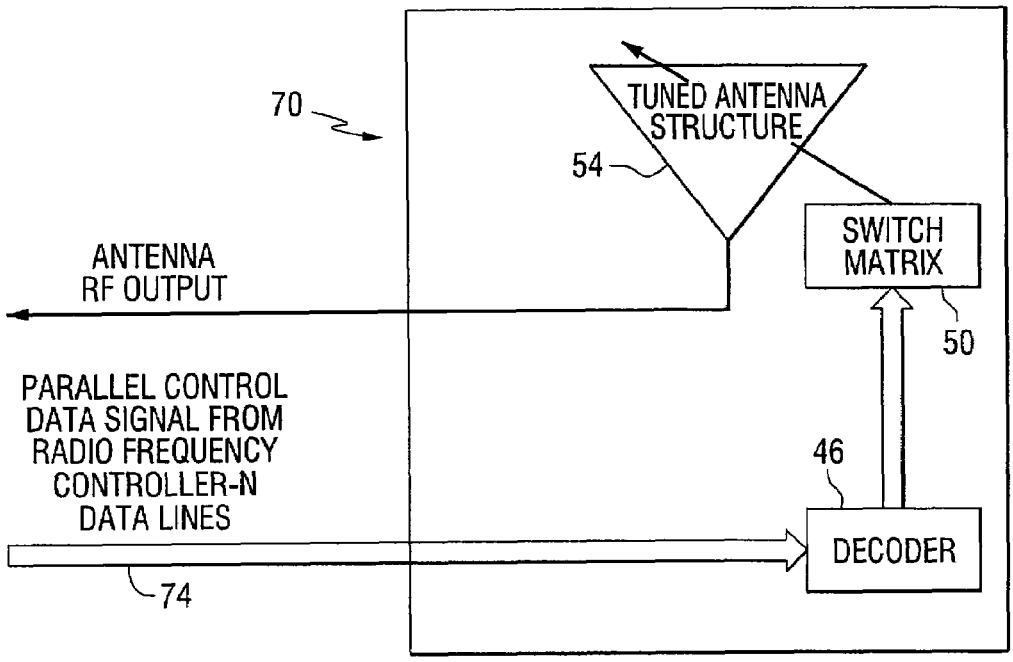

In a configuration of FIG. 3, an antenna system 70 receives a plurality of parallel data inputs on parallel date lines 74 (a data bus) that carry information indicating the frequency or channel to which the receiving system is tuned. This data word is decoded in the decoder 46 and supplied to the switch matrix 50 for controlling one or more switches (or other components that affect the antenna resonance frequency) to control resonance of the antenna structure 54.

Figure 4:
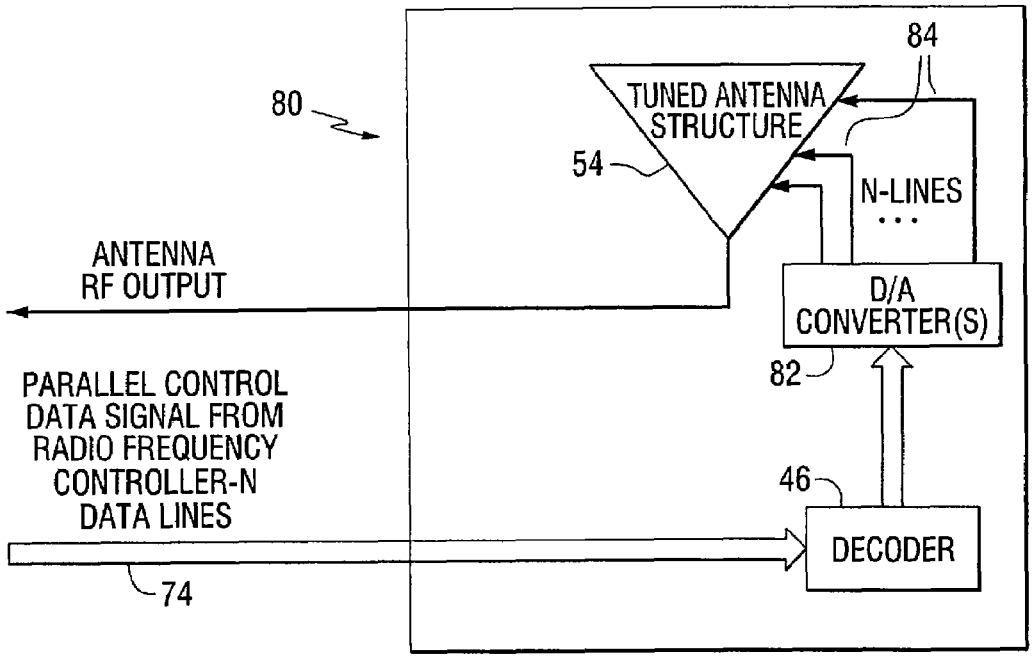

An embodiment of FIG. 4 comprises an antenna system 80. The antenna resonant frequency is controlled by one or more electrically controlled variable capacitors, such as a reverse-biased semiconductor diode, (varicap, etc). The reverse bias voltage, supplied from a digital-to-analog converter 82 responsive to a digital signal representing the current frequency or channel, is applied to each diode to control the capacitance across its terminals. The capacitance in turn controls the resonant frequency of the antenna structure 54. A different reverse bias may be required for each diode to optimally affect performance of the antenna system 80 in each operating band. The applied voltages remain static until the receiving system frequency is changes, whereupon the controller (not shown) provides a new digital signal representing the frequency information on the data lines 74 and the reverse bias voltages are changed accordingly by operation of the decoder 46 and the digital-to-analog converter 82.

Figure 5:
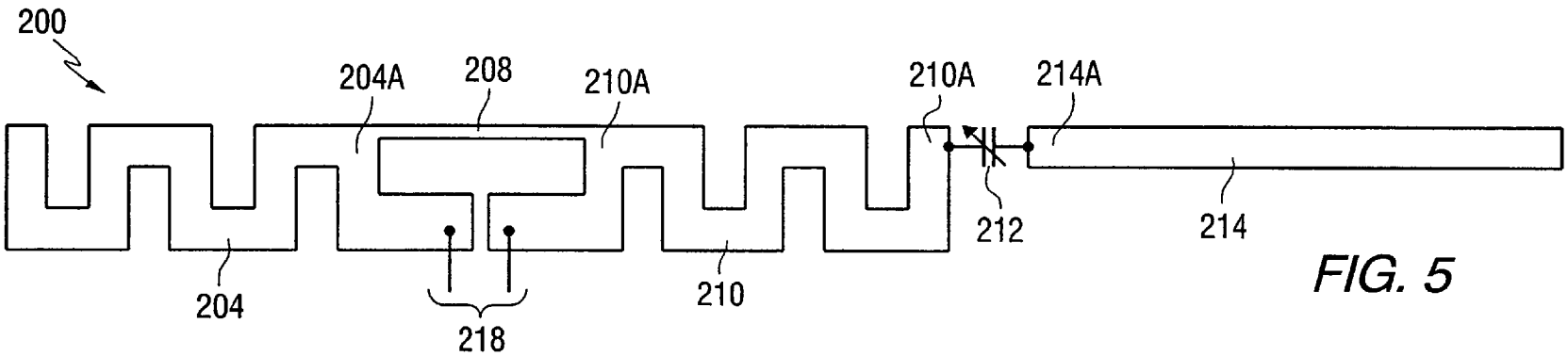
FIGS. 5 and 6 illustrate embodiments of an antenna structure according to the teachings of the present inventions.

FIG. 5 illustrates elements of an antenna 200 according to one embodiment of the present inventions, comprising a meanderline section 204 connected via a bridging section 208 to a meanderline section 210 (the elements 204, 208 and 210 forming a radiating structure). A variable capacitor 212 is interposed between an extension or arm 214 and a region 210A of the meanderline section 210. In one embodiment the variable capacitor 212 comprises a reverse-biased varactor diode where the reverse DC bias voltage determines the capacitance. Those skilled in the art recognize that other variable capacitance implementations can be used as the variable capacitor 212.

Terminals 218 supply signals to receiving circuits when the antenna structure 200 operates in a receive mode (and receive signals for transmitting when the antenna structure 200 operates in a transmit mode). Preferably, the antenna 200 is operative proximate a ground plane (not shown in FIG. 5).

When properly dimensioned, the antenna 200 presents tunable resonant frequencies in a band extending from about 470 MHz to about 860 MHz and a resonant frequency at about 1675 MHz. In this embodiment the antenna structure 200 can be tuned to a desired resonant frequency in the 470-860 MHz DVB band by changing the capacitance of the variable capacitor 212 and can be controlled to receive a DVB broadcast at 1675 MHZ. Thus the antenna 200 can be used with a communications device for receiving DVB signals in these two primary DVB broadcast bands/frequencies.

The conductive bridge 208 and the meanderline sections 204 and 210 cooperate to form a half wave dipole antenna (referred to as a primary antenna) with a resonant frequency of about 1675 MHz. Thus the effective electrical length of the bridge 208 and the meanderline sections 204 and 210 is about a half wavelength at about 1675 MHz.

Preferably an effective electrical length of the extension 214 is about equivalent to an effective electrical length of the radiating structure formed by the meanderline sections 204 and 210 and the bridging section 208. In one embodiment both effective electrical lengths are about a half wavelength (or a different fractional integer relationship) at about 1675

MHz. Therefore the resonance of the extension 214 does not adversely affect the resonance properties of the radiating structure formed by the meanderline sections 204 and 210 and the bridging section 208.

The low band resonance of the antenna structure 200 between 470 and 860 MHz is achieved by changing the capacitance of the variable capacitor 212. When the variable capacitor 212 is implemented as a varactor diode, the presented capacitance is responsive to the applied DC reverse-bias voltage. In one embodiment, a capacitance of about 10 pf provides a resonant frequency of about 470 MHz. A capacitance of about 1 picofarad causes the antenna 200 to be resonant at about 830 MHz. Resonant values between 470 and 860 MHz are achievable responsive to the different capacitance values.

The capacitance value presented by the variable capacitor 212 does not appreciably affect the high band resonant frequency of 1675 MHz. When the antenna 200 is operative in a communications receiving device, a signal indicating a desired receiving frequency may be provided to the antenna 200 to affect the capacitance of the variable capacitor 212 and thereby tune the antenna to the receiving frequency within the 470-860 MHz band. The antenna presents a resonant frequency of about 1675 MHz irrespective of the value of the capacitor 212.

In another embodiment (not illustrated) the extension 214 comprises a meanderline having an effective electrical length of about a half wavelength at the desired resonant frequency.

In another embodiment (not illustrated) the variable capacitor 212 is replaced by a fixed-value capacitor. Such an antenna is resonant in two spaced-apart frequency bands.

With reference to the antenna system 80 of FIG. 4 and the antenna structure 200 of FIG. 5, the digital-to-analog converter 82 supplies a controllable DC voltage (responsive to the to the frequency of the receiving system) to the variable capacitor 212 to control the capacitance linking the meanderline region 210A and the extension 214. In this embodiment only a single D/A converter 82 is required, since the antenna system 80 includes only one variable capacitance element.

The inventors have determined that if the effective electrical length of the extension 214 is different from the effective electrical length of the radiating structure formed by the meanderline sections 204 and 210 and the bridging section 208 at a given frequency, for example at 1675 MHz, then as the capacitance of the variable capacitor 212 is changed to tune the low frequency resonance, the resonance at 1675 MHz also shifts.

Figure 6:
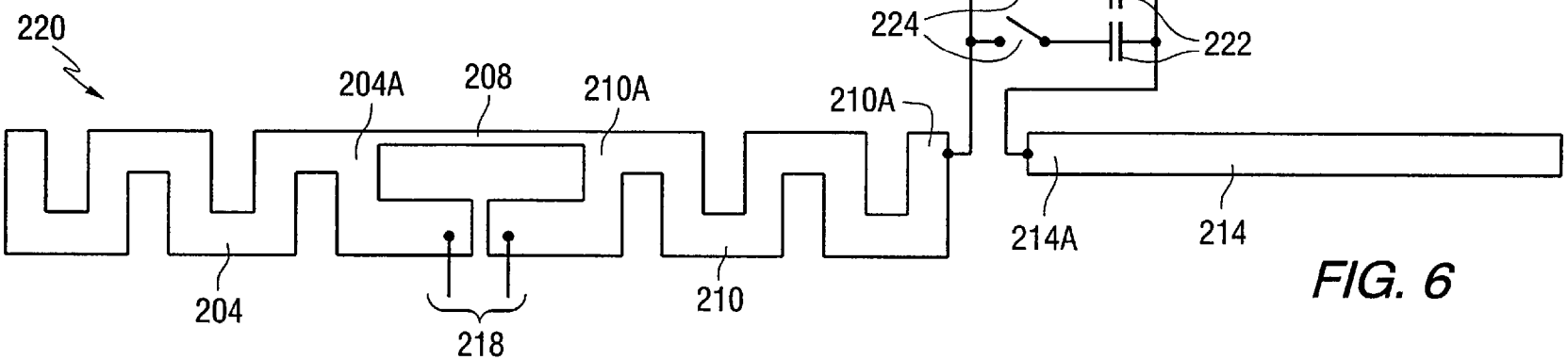

FIG. 6 illustrates an antenna 220 according to the teachings of the present invention comprising a plurality of fixed-value capacitors 222 each serially configured with a switch 224. One or more of the switches 224 are closed/opened to control the reactance between the meanderline section 210 and the extension 214. In one embodiment the switches 224 are controlled (opened/closed) responsive to a desired operating frequency for the antenna structure 220. The switches 224 can be implemented with MOSFET (metal oxide semiconductor filed effect transistors) or MEMS (microelectromechanical system) devices. The capacitors 222 can be implemented with common chip capacitors, varactor or MOSFETS. Those skilled in the art recognize that other devices can be used to implement the switches 224 and the capacitors 222.

In yet another embodiment, the fixed-value capacitors 222 are replaced with variable capacitors (e.g., varactor diodes) to provide additional tuning capabilities for the antenna 220. Further, each variable capacitor can provide a different capacitance range. Thus variable capacitance valued can be presented responsive to the closure of one or more switches and further responsive to the value of the capacitance selected for any of the closed switches. Such an embodiment provides additional tuning capabilities for the antenna, including tuning to and within different frequency bands than the exemplary DVB bands discussed herein.

In yet another embodiment (not illustrated) switches can be located to switchably connection the meanderline region 210A and the extension region 214A (see FIG. 5 or 6), or to connect the meanderline region 210A to ground or to connect the extension region 214A to ground. Each of these switch configurations provides a different resonant condition for the antenna structure.

With reference to the antenna system 70 of FIG. 3 and the antenna structure 220 of FIG. 6, the switch matrix 50 of FIG. 3 corresponds to the switches 224 of FIG. 6.

Figure 7:
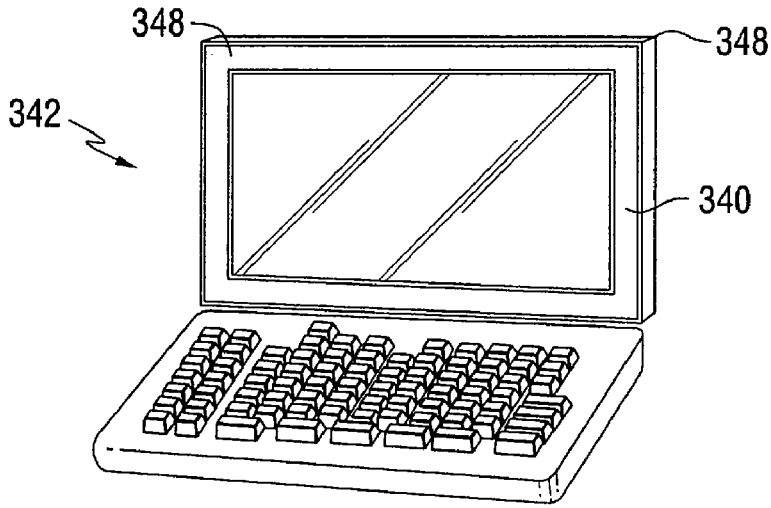
FIG. 7 illustrates a laptop computer application for the antenna systems and structures of the present invention.

In one application, the antenna 200 or 220 of respective FIGS. 5 and 6 is disposed within a top cover 340 (see FIG. 7) of a laptop computer 342 in a region indicated generally by a reference character 348.

Figure 8:
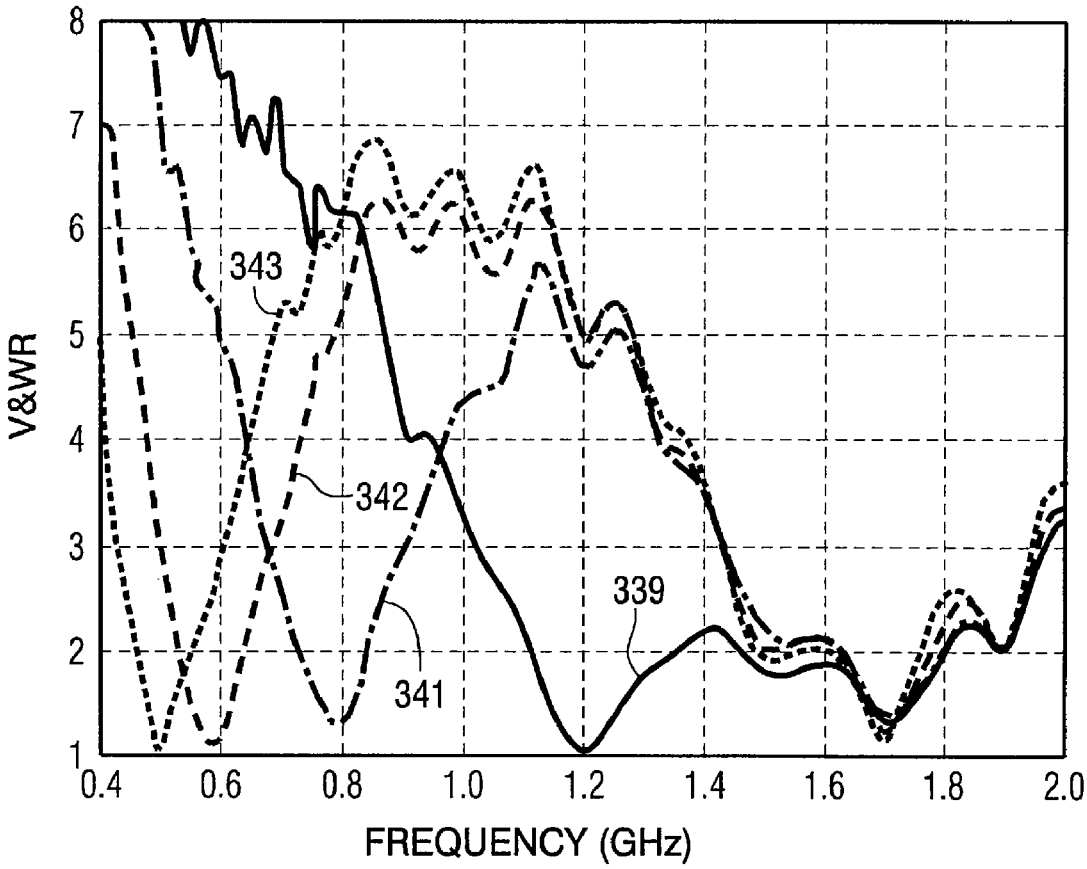
FIG. 8 is a graph illustrating VSWR (voltage standing wave ratio) conditions as a function of frequency for a tunable antenna structure according to the present inventions.

Exemplary results for an antenna structure constructed according to the teachings of the present invention, such as the antenna structure 200 of FIG. 5 with a voltage controlled variable capacitance element are shown in FIG. 8. The voltage standing wave ratio as a function of frequency and capacitance is shown. Four capacitance values were employed to generate the four curves of FIG. 8: a curve 340 was generated with an open circuit, a curve 341 with a 1 pf capacitance, a curve 342 with a 5.7 pf capacitance and a curve 343 with a short circuit. Using these capacitance values, the exemplary DVB antenna presents several resonant frequencies within the tunable band of 470 to 860 MHz (in which narrowband (5-8 MHz) video signals are transmitted) according to the capacitance value. As can further be seen, the upper resonant frequency, corresponding to the DVB broadcast band centered at about 1675 MHz (and having about a 5 MHz bandwidth), remains substantially unchanged irrespective of the capacitance.

Figure 9:
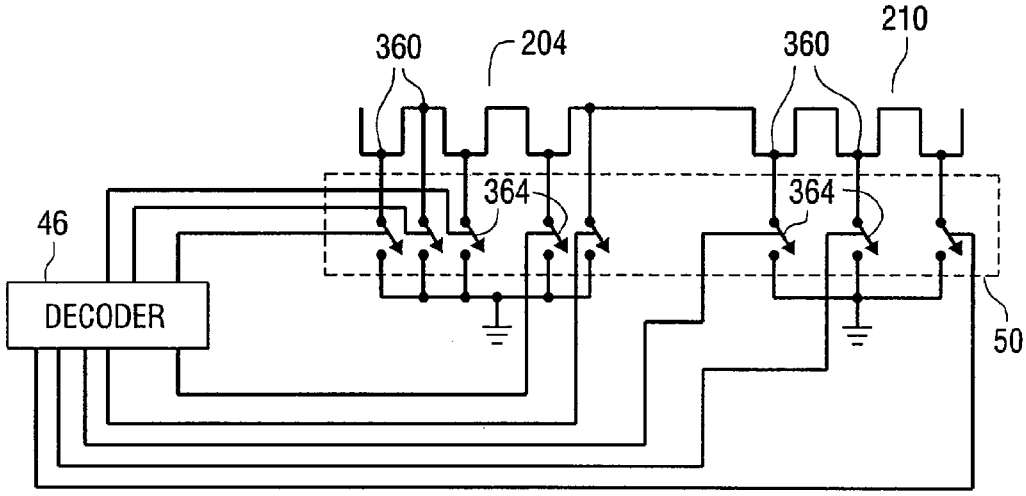
FIGS. 9 and 10 illustrate antenna structures for use with one or more of the embodiments of FIG. 1-4.

FIG. 9 illustrates another tunable antenna structure (for use as the tunable antenna structure 54 of FIG. 1, for example), wherein resonance tuning within the 470-860 MHZ band is accomplished by shorting one or more segments of the meanderline 204 and 210 to ground. Exemplary taps 360 connected to one or more of the meanderline segments are controllably connected to ground by closing an associated switch 364 under control of the decoder 46. Connecting one or more of the meanderline segments to ground changes the effective electrical length of the meanderline 204 and 210 thereby changing the antenna effective electrical length and its resonant frequency, especially the resonant frequency at about 1675 MHz.

In one embodiment the switches 364 are implemented by connecting one or more of the taps 360 to ground through an inductor (not shown) to establish a DC ground for each tap 360.

Figure 10:
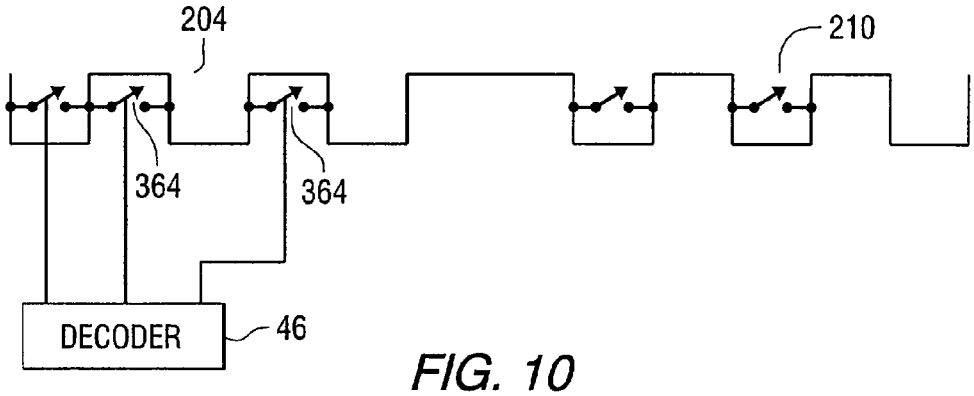

FIG. 10 illustrates an antenna structure comprising the meanderline 204 and 210 and exemplary switches 364 controlled by the decoder 46. Closing one or more of the switches 364 shorts the corresponding meanderline segments to tune the antenna structure, especially the resonant frequency at about 1675 MHz.

Figure 11:
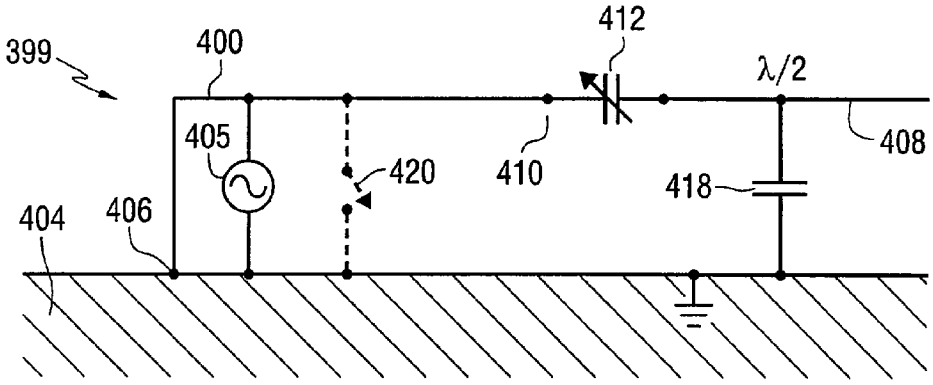
FIG. 11 illustrates an embodiment of an antenna structure constructed according to the teachings of the present invention.

FIG. 11 schematically illustrates another embodiment of an antenna structure 399 according to the present invention, comprising an inverted F radiating structure 400 (or an inverted planar F radiating structure) over a ground plane or counterpoise 404. The radiating structure 400 is fed from a feed 405 (in the transmitting mode) and is connected to the counterpoise 404 at a terminal 406. The structure 400 is approximately a quarter wavelength long at the resonant frequency. Alternatively, in another embodiment the structure is approximately a half wavelength long at the resonant frequency and the ground plane is absent.

The antenna structure 399 further comprises an extension 408 capacitively coupled to a terminal region 410 of the radiating structure 400 via a variable capacitor 412, with the capacitance value selected responsive to a desired resonant frequency. In one embodiments the capacitor 412 comprises a varactor diode as described above. The extension 408 comprises a conductive rectangular shape, a meanderline or another shape that presents a half wavelength resonating element at the frequency of interest.

If the capacitor is an effective short at the desired frequency, the combination of the radiating structure 400 and the extension 408 presents a three-quarter wavelength structure. Thus if the resonant frequency of the structure/counterpoise combination 400/404 is $f_0$, then the resonant frequency with a shorted capacitor is about $f_0/3$. As in the embodiments described above, the frequency $f_0$ remains relatively fixed as the lower resonant frequency is tuned by varying the capacitance of the capacitor 412. Specifically, the lower resonant frequency increases as the reactance presented by the capacitor is varied through a range from the short circuit to an open circuit.

In one application, the antenna structure 399 is embedded in a handset communication device, where conductive elements (e.g., a printed circuit board ground plane, conductive material of the device case) may serve as the counterpoise 404.

The antenna structure 399 may present a broader bandwidth above and below 1675 MHz than other antenna embodiments described herein according to the teachings of the inventions.

In another embodiment, a segment of the radiating structure 400 between the feed 405 and the capacitor 412 is replaced with a meanderline appropriately dimensioned to provide the desired resonance characteristics.

In another embodiment, the antenna structure 399 of FIG. 11 further comprises a capacitor 418 connected between the extension 408 and ground. Inclusion of the capacitor 418 and/or the varying the capacitance presented by the capacitor 418 causes both of the low and high resonant frequencies to shift and changes the difference between the high and low resonant frequencies. A relatively large value capacitor lowers both the high band and low band resonant frequencies. Thus inclusion of the capacitor 418 and the ability to vary the capacitance presented, offer additional tuning capabilities for the antenna 400.

If the quarter wavelength radiating structure/counterpoise combination 400/404 of FIG. 11 is replaced by a half wavelength dipole without a counterpoise, the lower resonant frequency is about $f_0/2$ with an upper resonant frequency of $f_0$. Changing the capacitance of the capacitor 412 over the range from a short to an open tunes the lower resonance from about $f_0/2$ to higher frequencies.

In yet another embodiment, the antenna structure of FIG. 11 further comprises one ore more switches (one such switch 420 illustrated in phantom) for switchably connecting regions of the antenna structure to ground, by closing the switch, to tune the antenna structure within the low frequency band.

Figure 12:
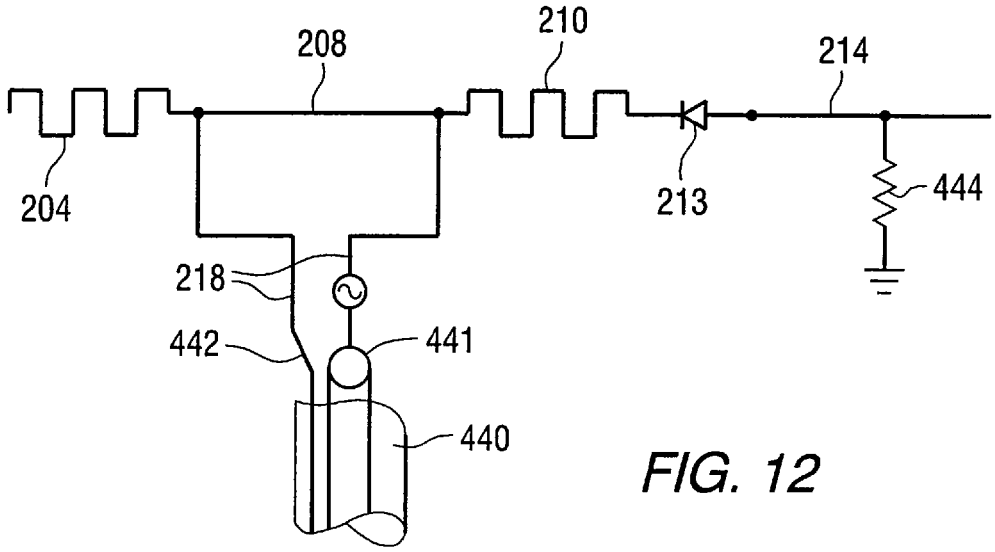
FIG. 12 illustrates a technique for biasing a varactor diode for use with the antenna structures of the present inventions.

FIG. 12 schematically illustrates a technique for biasing the varactor diode operating as the variable capacitor in the embodiments described above. A coaxial cable 440, comprising a signal conductor 441 and a ground conductor 442, is connected to the terminals 218 of the antenna structure 200 for supplying the received signal to receiving circuitry not illustrated. A resistor 444 is connected between the extension 218 and ground. A reverse bias DC voltage is applied between the signal conductor 441 and ground. In a preferred embodiment the structures of FIG. 12 are disposed proximate a ground plane.

Figure 13:
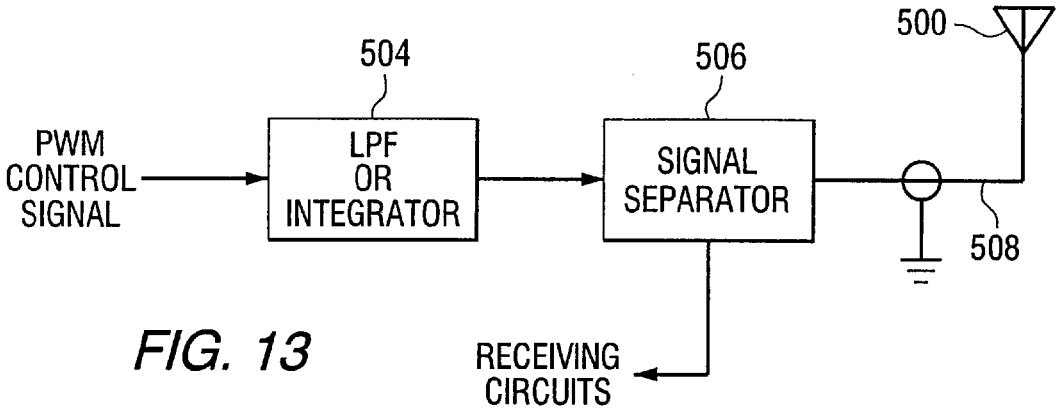
FIG. 13 illustrates another embodiment of an antenna system according to the teachings of the present invention.

FIG. 13 illustrates another technique for supplying a control signal to a DC tunable antenna 500. In this embodiment, a control signal in the form of a pulse width modulated (PWM) signal indicates a receiving frequency for the communications device operative with the antenna 500. The PWM signal is input to an integrator or low pass filer 504 to produce a DC value representative of the receiving frequency. The DC value is supplied to a signal separator 506 for isolating the DC signal from a radio frequency signal received by the antenna 500. From the signal separator 506 the DC signal is impressed on a coaxial cable 508 and supplied to the antenna 500, where the DC value controls certain antenna characteristics to tune the antenna 500 as described elsewhere herein. The received radio signal is also carried over the coaxial cable 508 through the signal separator 506 to receiving circuits of the communications device.

Figure 14:
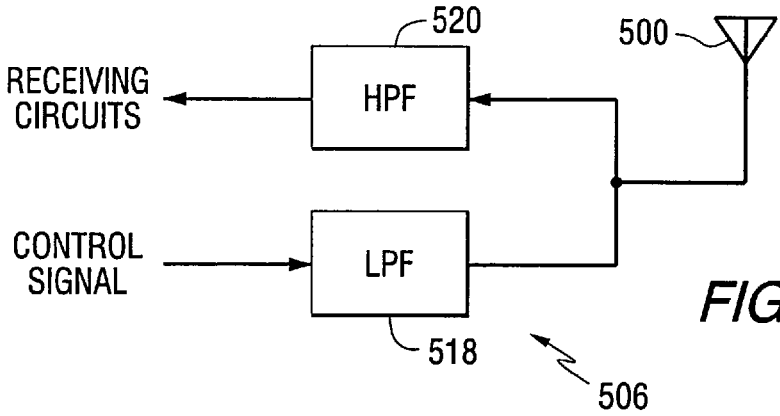
FIG. 14 illustrates details of a signal separator element of FIG. 13.

FIG. 14 depicts one implementation of the signal separator 506 of FIG. 13, comprising a low pass filter 518 and a high pass filter 520.

Figure 15:
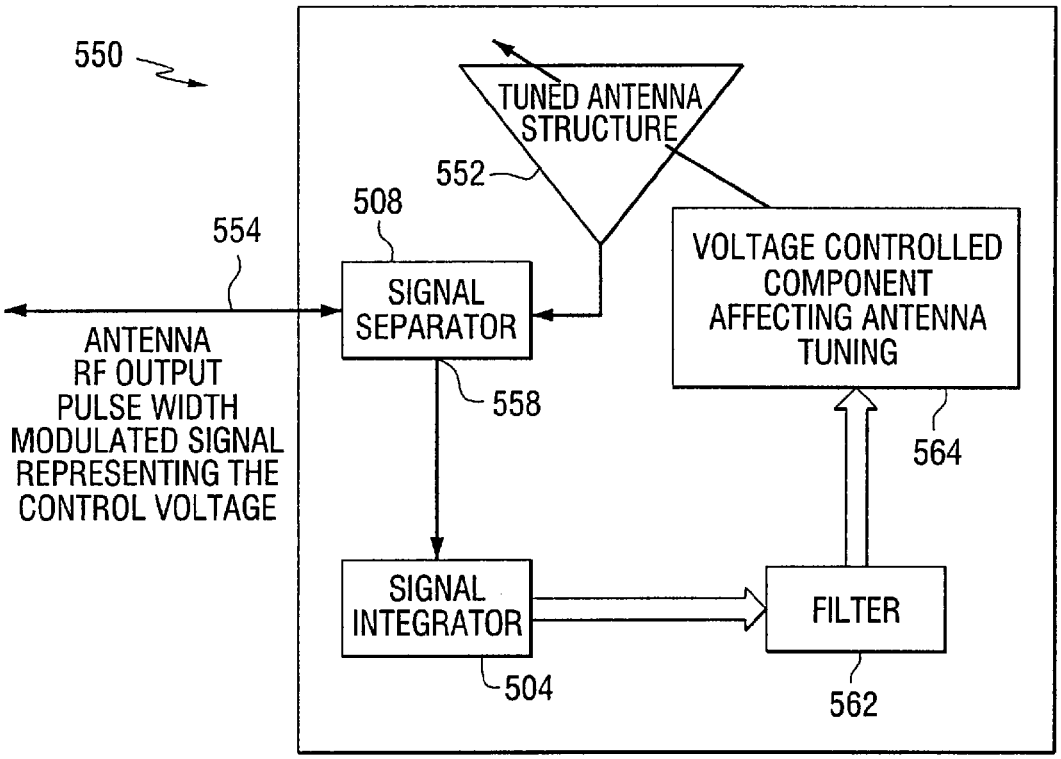
FIG. 15 illustrates an embodiment of an antenna system constructed according to the teachings of the present invention.

Another antenna system 550 is illustrated in FIG. 15, wherein a pulse width modulated (PWM) control signal is supplied to the signal separator 506. In one embodiment, the signal separator comprises a high pass filter for passing the radio frequency signal received by an antenna 552 to a conductor 554 and a low pass filter for passing the control signal to a port 558. The control signal is integrated in the integrator 504 and further filtered in an optional filter 562. Voltage controlled components (e.g., varactor diodes, variable capacitors, reverse-biased common diodes) that affect the tuning of the antenna 552 are represented by a reference character 564. Thus the PWM control signal tunes the antenna 552 according to the desired receiving frequency of a communications device in which the antenna system 550 is operative.

The various presented embodiments comprising the tuning capacitor (e.g., a varactor) also provide the capability to tune the antenna to overcome the affect of the user's hand (for an antenna incorporated into a handset device) on the antenna resonance. The affect of the user's body (for an antenna incorporated into a laptop computer) or proximate objects can also be avoided by proper tuning of the antenna according to the teachings of the present invention.

The embodiments of the inventions employing balanced antenna structures have better noise immunity, from internal or external noise sources, over other prior art antenna structures.

To design an antenna according to the present invention, it is first necessary to empirically determine an antenna's resonant frequencies responsive to the use of different capacitance values between the meanderline segment 210 and the extension 212 (see the embodiment of FIG. 5). The antenna is designed to include a technique for varying the capacitance (a variable capacitor (as in FIG. 5) or a plurality of serially configured switches and capacitors (as in FIG. 6), for example). In operation, the desired capacitance is inserted between the meanderline segment 210 and the extension 212 responsive to a control signal indicating s desired receiving frequency, thereby requiring tuning the antenna to a resonant frequency at least near the desired receiving frequency.

In other embodiments, other radiating structures can be substituted for the depicted high-band radiating structures (e.g., the meanderline 204/210 and the conducting bridge 208 of FIG. 5 or the radiating structure 400 of FIG. 11), including radiating structures presenting wide or narrow bandwidths at the high resonant frequency.

While the present invention has been described with reference to preferred embodiments, it will be understood by those skilled in the art that various changes may be made and functionally equivalent elements may be substituted for the elements thereof without departing from the scope of the invention. For example, although the invention has been described in the context of an antenna for receiving DVB signals, the teachings of the invention can be applied to receiving (and transmitting) signals at different frequencies. The scope of the present invention further includes any combination of elements from the various embodiments set forth herein. In addition, modifications may be made to adapt a particular situation to the teachings of the present invention without departing from its essential scope. Therefore, it is intended that the invention not be limited to the particular embodiments disclosed, but that the invention will include all embodiments falling within the scope of the appended claims.

What is claimed is:

1. An antenna providing a tunable resonant frequency within a low frequency band and further providing a high resonant frequency, the antenna comprising:

a first radiating structure of a first effective electrical length;

a second radiating structure of a second effective electrical length having a fractional integer relationship to a wavelength related to the high resonant frequency;

a variable reactance element connecting the first and the second radiating structures, wherein varying a reactance of the variable reactance element tunes the antenna within the low frequency band; and wherein the first effective electrical length has a fractional integer relationship to the high resonant frequency approximately equal to the fractional integer relationship of the second effective length to the high resonant frequency.

2. The antenna of claim 1 wherein the second effective length is about one-half of the wavelength of the high resonant frequency.

3. The antenna of claim 1 responsive to a signal representing a desired operating frequency for the antenna, wherein the reactance of the variable reactance element is responsive to the desired operating frequency.

4. The antenna of claim 3 wherein the variable reactance element comprises a variable capacitor responsive to the signal for controlling a capacitance presented by the variable capacitor.

5. The antenna of claim 4 wherein the variable capacitor comprises a varactor diode, and wherein the signal controls a reverse DC bias applied to the varactor diode to control the capacitance presented by the varactor diode.

6. The antenna of claim 3 operative with a communications device providing a digital signal representing an operating frequency of the communications device, the antenna further comprising an element for converting the digital signal to an analog signal, the analog signal for affecting the reactance of the variable reactance element.

7. The antenna of claim 6 wherein the variable reactance element comprises a varactor diode, and wherein a reverse DC bias applied to the varactor diode for affecting the capacitance thereof is responsive to the analog signal.

8. The antenna of claim 1 wherein the first radiating structure comprises first and second meanderline conductive segments connected by a conductive bridging segment.

9. The antenna of claim 1 wherein the second radiating structure comprises a planar conductive element.

10. The antenna of claim 1 wherein the low frequency band comprises frequencies between about 470 MHz and 860 MHz, and wherein the high resonant frequency is about 1675 MHz.

11. The antenna of claim 1 wherein the variable reactance element comprises one or both of a controllably variable capacitance and a controllably variable inductance.

12. The antenna of claim 1 wherein the first radiating structure comprises an inverted F antenna structure.

13. The antenna of claim 1 further comprising a proximate ground plane.

14. The antenna of claim 13 further comprising a reactive element connected between the second radiating structure and the ground plane.

15. The antenna of claim 14 wherein the reactive element comprises a variable capacitor.

16. The antenna of claim 1 wherein the first effective electrical length and the second effective length are each about a half wavelength at the high resonant frequency.

17. An antenna providing a tunable first resonant frequency within a low frequency band and further providing a second resonant frequency at a high frequency, the antenna comprising:

a first and a second radiating structure, wherein the first radiating structure comprises first and second meanderline conductive segments connected by a conductive bridging segment;

a variable reactance element electrically connecting the first and the second radiating structures, wherein controllably varying a reactance of the variable reactance element tunes the antenna within the low frequency band; and wherein at the second resonant frequency the first radiating structure is a primary radiating structure, and wherein a combination of the first and the second radiating structures, as determined by a reactance of the variable reactance element, provide the tunable first resonant frequency within the low frequency band.

18. The antenna of claim 17 the second radiating element having an effective electrical length of one-half of a wavelength of the high resonant frequency.

19. The antenna of claim 18 the first radiating element having an effective electrical length of one-half of a wavelength of the high resonant frequency.

20. The antenna of claim 17 responsive to a signal representing a desired operating frequency for the antenna, wherein the reactance of the variable reactance element is responsive to the signal representing the desired operating frequency.

21. The antenna of claim 17 wherein the second radiating structure comprises a planar conductive element.

22. The antenna of claim 17 wherein the low frequency band comprises frequencies between about 470 MHz and 860 MHz, and wherein the second resonant frequency is about 1675 MHz.

23. An antenna providing a low resonant frequency and a high resonant frequency, the antenna comprising:

a first radiating structure of a first effective electrical length, wherein the first radiating structure comprises first and second meanderline conductive segments connected by a conductive bridging segment;

a second radiating structure of a second effective electrical length having a fractional integer relationship to a wavelength related to the high resonant frequency; and a reactance element electrically connecting the first and the second radiating structures, wherein a reactance of the reactance element determines the low resonant frequency.

24. The antenna of claim 23 wherein the first effective electrical length has a fractional integer relationship to the high resonant frequency.

25. The antenna of claim 23 wherein the first and the second effective lengths have the same fractional integer relationship to the high resonant frequency.

26. The antenna of claim 23 wherein the fractional relationship comprises an effective electrical length of one-half of the wavelength of the high resonant frequency.

27. The antenna of claim 23 wherein the second radiating structure comprises a planar conductive element.

28. An antenna providing a tunable resonant frequency within a low frequency band and further providing a high resonant frequency, the antenna comprising:

a first and a second radiating structure; and a plurality of switchably controllable reactance elements disposed between the first and the second radiating structures, wherein one or more of the plurality of switchably controllable reactance elements are connected between the first and the second radiating structures to vary a reactance between the first and the second radiating structures and thereby tune the antenna within the low frequency band.

29. The antenna of claim 28 wherein an effective electrical length of the first and the second radiating structures have the same fractional integer relationship to a wavelength of the high resonant frequency.

30. The antenna of claim 28 wherein an effective electrical length of the second radiating structure is one-half of a wavelength of the high resonant frequency.

31. The antenna of claim 28 responsive to a signal representing a desired operating frequency for the antenna, wherein one or more of the plurality of switchably controllable reactance elements is responsive to the signal to tune the antenna within the low frequency band.

32. The antenna of claim 31 wherein each one of the plurality of switchably controllable reactance elements comprises a serial configuration of a switch element and a capacitor, and wherein one or more of the switches are configured to a closed state responsive to the signal.

33. The antenna of claim 28 wherein the first radiating structure comprises first and second meanderline conductive segments connected by a conductive bridging segment.

34. The antenna of claim 28 wherein the second radiating structure comprises a planar conductive element.

* * * * *